US006856690B1

(12) United States Patent
Skulley

(10) Patent No.: US 6,856,690 B1
(45) Date of Patent: Feb. 15, 2005

(54) COMFORTABLE EARPHONE CUSHIONS

(75) Inventor: Gerald W. Skulley, Aptos, CA (US)

(73) Assignee: Plantronis, Inc., Santa Cruz, CA (US)

( * ) Notice: Subject to any disclaimer, the term of this patent is extended or adjusted under 35 U.S.C. 154(b) by 258 days.

(21) Appl. No.: 10/043,613

(22) Filed: Jan. 9, 2002

(51) Int. Cl.[7] ..... H04R 25/00
(52) U.S. Cl. ..... 381/371; 381/367
(58) Field of Search ..... 381/370, 371, 381/375, 376, 380, 189, 361, 367, 368, 374; 2/209; 279/430; 181/129, 130, 135

(56) References Cited

U.S. PATENT DOCUMENTS

| | | | | |
|---|---|---|---|---|
| 1,368,307 A | | 2/1921 | Waldron | |
| 2,235,372 A | | 3/1941 | Kalbitz | 179/156 |
| 2,408,494 A | | 10/1946 | Veneklasen | 179/182 |
| 2,468,721 A | | 4/1949 | Volkmann | 179/182 |
| 2,856,469 A | | 10/1958 | Morse | 179/182 |
| 2,989,598 A | | 6/1961 | Touger et al. | 179/182 |
| 3,030,458 A | | 4/1962 | Gongoll | 179/182 |
| 3,051,961 A | | 9/1962 | Clark | 2/209 |
| 3,073,410 A | | 1/1963 | Gongoll et al. | 181/23 |
| 3,134,456 A | | 5/1964 | Wadsworth | 181/23 |
| 3,160,717 A | * | 12/1964 | Beguin | 381/372 |
| 3,220,505 A | | 11/1965 | Hargrave | 181/23 |
| 3,456,263 A | | 7/1969 | Aileo | |
| 3,571,813 A | | 3/1971 | Allen | 2/209 |
| 3,602,329 A | | 8/1971 | Bauer et al. | 181/23 |
| 3,645,354 A | | 2/1972 | Kliewer | 181/23 |
| 3,798,393 A | | 3/1974 | Gorike | 179/182 |
| 4,005,278 A | * | 1/1977 | Gorike | 381/373 |
| 4,041,256 A | | 8/1977 | Ohta et al. | 179/182 |
| 4,058,688 A | | 11/1977 | Nishimura et al. | 179/156 |
| 4,071,717 A | | 1/1978 | Fidi et al. | 179/182 |
| 4,087,653 A | | 5/1978 | Frieder, Jr. et al. | 179/156 |
| 4,156,118 A | | 5/1979 | Hargrave | 179/182 |
| 4,160,135 A | | 7/1979 | Gorike | 179/182 |
| 4,170,275 A | | 10/1979 | Larsen | 181/129 |
| 4,239,945 A | | 12/1980 | Atoji et al. | 179/182 |
| 4,278,852 A | | 7/1981 | Gorike | 179/182 |
| 4,302,635 A | | 11/1981 | Jacobsen et al. | 179/156 |
| 4,389,542 A | | 6/1983 | Gorike | 179/1 |
| 4,437,538 A | | 3/1984 | Ohlsson et al. | 181/129 |
| 4,523,661 A | * | 6/1985 | Scalzo et al. | 181/129 |
| 4,529,058 A | | 7/1985 | Emery | 181/129 |

(List continued on next page.)

FOREIGN PATENT DOCUMENTS

JP 2001309478 A * 11/2001 ..... H04R/1/10

*Primary Examiner*—Huyen Le
*Assistant Examiner*—Brian Ensey
(74) *Attorney, Agent, or Firm*—Peter Hsieh

(57) ABSTRACT

A cushion for a headset earphone comprises a resilient ring having opposite input and output faces, and a through-opening defining an interior surface between the two faces. The input face has structure for acoustically coupling the opening to an output face of an audio speaker, and the output face is resiliently conformable to a lateral face of an external ear of a listener, thereby acoustically coupling the opening, and hence, the speaker, to the listener's ear. The interior surface of the cushion can be configured to effectively match the acoustical impedance at the output face of the speaker to the acoustical impedance at the entrance of the listener's ear. In one possible embodiment, the ring is formed of an elastomer filled with microcapsules containing a material capable of an endothermic phase changes at a constant temperature, such that the cushion more effectively conducts heat away from the ear, thereby providing long term listening comfort. In another embodiment, the through-opening is acoustically coupled to the output of the transducer with an acoustic plug such that the cushion is flexibly articulated about the plug relative to the speaker, thereby enabling the cushion to comply more easily to the listener's ear using lower contact forces between the cushion and the ear.

26 Claims, 2 Drawing Sheets

U.S. PATENT DOCUMENTS

| | | | | |
|---|---|---|---|---|
| 4,572,324 | A | | 2/1986 | Fidi et al. ..... 181/129 |
| 4,634,816 | A | | 1/1987 | O'Malley et al. ..... 379/430 |
| 4,674,134 | A | | 6/1987 | Lundin ..... 2/209 |
| 4,689,822 | A | | 8/1987 | Houng ..... 381/183 |
| 4,771,454 | A | | 9/1988 | Wilcox, Jr. ..... 379/430 |
| 4,856,118 | A | | 8/1989 | Sapiejewski ..... 2/209 |
| 4,875,233 | A | | 10/1989 | Derhaag et al. ..... 379/430 |
| 4,922,542 | A | | 5/1990 | Sapiejewski ..... 381/187 |
| 4,958,697 | A | | 9/1990 | Moody ..... 181/129 |
| 4,989,271 | A | | 2/1991 | Sapiejewski et al. ..... 2/209 |
| 5,003,631 | A | | 4/1991 | Richardson ..... 2/6 |
| 5,018,599 | A | | 5/1991 | Dohi et al. ..... 181/129 |
| 5,138,722 | A | | 8/1992 | Urella et al. ..... 2/209 |
| 5,555,554 | A | | 9/1996 | Hofer et al. ..... 381/183 |
| 5,677,964 | A | | 10/1997 | Sun ..... 381/187 |
| D391,575 | S | | 3/1998 | Bergin et al. ..... D14/223 |
| 5,736,785 | A | | 4/1998 | Chiang et al. ..... 257/712 |
| 5,761,298 | A | | 6/1998 | Davis et al. ..... 379/430 |
| 5,821,468 | A | | 10/1998 | Urella et al. ..... 181/129 |
| 5,911,314 | A | | 6/1999 | Urella et al. ..... 2/209 |
| 5,960,094 | A | | 9/1999 | Jensen et al. ..... 381/381 |
| 6,097,809 | A | | 8/2000 | Lucey et al. ..... 379/430 |
| 6,099,894 | A | * | 8/2000 | Holman ..... 427/126.3 |
| 6,101,260 | A | | 8/2000 | Jensen et al. ..... 381/381 |
| 6,163,615 | A | | 12/2000 | Callahan ..... 381/371 |
| 6,252,970 | B1 | | 6/2001 | Poon et al. ..... 381/374 |
| 6,295,366 | B1 | | 9/2001 | Haller et al. ..... 381/374 |

* cited by examiner

COMFORTABLE EARPHONE CUSHIONS

BACKGROUND

1. Technical Field

This invention generally pertains to communication headsets containing earphones, and more particularly, to cushions for the earphones that provide enhanced wearing comfort.

2. Related Art

Headsets with earphones, and optionally, associated microphones, are well known and widely used in broadcast and two-way communications. Headsets provide the advantages of a hands-free listening that is isolated to the listener, i.e., the earphones closely couple the sounds they produce to the listener's ear such that, on the one hand, the sounds are relatively free from interference from other sounds present in the listener's environment, and on the other hand, such that the sounds do not escape to the listener's environment to be overheard by, or interfere with, the listening of bystanders.

Headsets, which can incorporate one or two earphones for monaural or stereo listening, can be classified into three general types in accordance with the type of ear-phone that they employ: 1) "In-the-ear" type earphones, sometimes referred to as "ear buds," which fit into the concha, or entrance to a wearer's middle ear, such as that described in U.S. Pat. No. 5,761,298 to M. Davis, et al.; 2) "On-the-ear" types that couple against a lateral face of the auricle, or external ear, of the wearer, such as that described in U.S. Pat. No. 5,960,094 to W. Jensen, et al.; and, 3) "Over-the-ear" types that surround and form a closed chamber over the auricle of the listener, such as that described in U.S. Pat. No. 6,295,366 to L. Haller, et al.

Headsets, particularly those of the two latter types, typically incorporate some structure, such as a yoke or headband, for forcefully maintaining the output face of the earphone in, against, or over the ear of the wearer. As a consequence, the force exerted by the earphones against the ear or head of the wearer can become uncomfortable after extended periods of wear. Additionally, the wearer's body heat can also build up in the interface between the earphone and the ear or the head of the wearer to an uncomfortable level.

SUMMARY

In accordance with the invention, a cushion for an earphone of a headset affords a wearer of the headset improved, long-term wearing comfort, including enhanced cooling of the wearer's ears and a reduction in the force needed to acoustically couple the ear-phone to the wearer's ear.

In one possible embodiment, the cushion comprises a resilient ring having opposite input and output faces, a thickness between the faces, and a through-opening defining an interior surface. The ring may be variously shaped. The interior surface of the ring may flare out between the input faces and output faces, like a horn, to match the acoustic impedance at the output face of an electro-acoustic transducer, or speaker, to that at the entrance of a listener's ear. The ring includes structure associated with the input face for acoustically coupling the through-opening of the ring to the output face of the speaker, and the output face of the ring is made resiliently conformable to the lateral face of the listener's external ear to acoustically couple the through-opening, and thus, the speaker, to the listener's ear.

In another advantageous embodiment, the cushion can comprise a foamed elastomer incorporating microcapsules of a proprietary "phase change" material that is capable of an endothermic phase change at a substantially constant temperature, which can be "pre-set," or fixed, at a particular value at the time the microcapsules are made, and before they are incorporated into the elastomer. The phase-change material imbues the cushion with a substantially enhanced specific heat and thermal conductivity, and thereby enables an earphone incorporating the cushion to be worn against the ear for longer periods of time without an uncomfortable buildup of heat.

In yet another advantageous embodiment, the output face of the speaker is provided with a flange, and the interior surface of the ring of the cushion is provided with a complementary recess located inside of the input face thereof and configured to resiliently receive the flange of the speaker in a complementary, over-center engagement. The through-opening of the ring is acoustically coupled to the output face of the speaker by inserting the output face of the speaker into the through-opening at the input face until the flange on the speaker is received and retained in the recess.

In this one-piece cushion embodiment, the cushion ring may also be provided with an exterior circumferential recess located between the output face of the ring and the interior, flange-receiving recess. The circumferential recess serves to resiliently articulate an output face portion of the cushion relative to an input face portion thereof, thereby: rendering the output face of the cushion more easily compliable to the lateral face of the listener's ear without requiring uncomfortably high contact forces between the cushion and the ear. The circumferential recess also increases the external surface area of the cushion, thereby enabling it to transfer more heat away from the interface with the listener's ear.

In still yet another advantageous embodiment, the cushion ring may be acoustically coupled to the output face of a speaker by a second resilient ring having a recess into which a flange on the speaker is resiliently inserted and retained in a manner similar to that described above. A third, rigid retainer ring is captivated within the recess in the second ring along with the flange on the speaker. A first end of an acoustic plug is inserted though the respective openings of the cushion ring, the second ring, and the third ring, and retained therein by the third ring. The plug has a flange on an end opposite to the first end that presses a first portion of the input face of the cushion ring against a corresponding portion of an output face of the second ring.

In this multi-piece cushion embodiment, a second portion of the input face of the cushion ring circumscribing the flange of the plug may be spaced apart from a corresponding portion of the output face of the second ring to resiliently articulate the cushion ring relative to the second ring and speaker, thereby increasing the external surface area of the cushion for improved heat transfer from the interface between the cushion and the ear, and rendering the output face of the cushion more easily compliable to the lateral face of the listener's ear without requiring uncomfortably high contact forces between the cushion and the ear.

By equipping a headset with at least one earphone incorporating one of the novel cushions of the present invention, a wearer of the headset can experience improved, long-term wearing comfort, including enhanced cooling of the wearer's ear and a reduction in the force required to couple the earphone to the wearer's ear.

A better understanding of the above and other features and advantages of the invention may be had from a consideration of the following detailed description of some exemplary embodiments thereof, particularly if such consideration is made in conjunction with the figures of the accompanying drawings.

DETAILED DESCRIPTION

Figure 1:
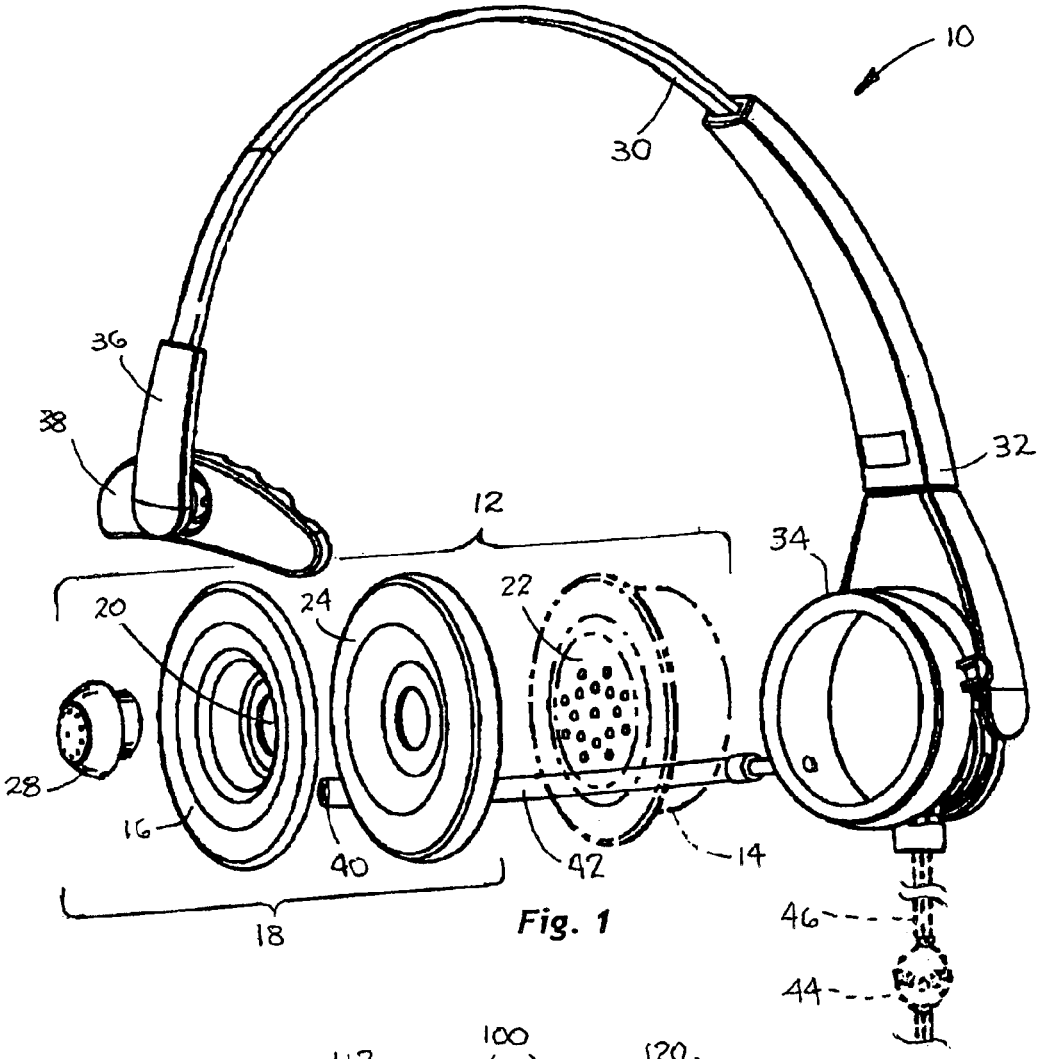
FIG. 1 is an expanded isometric view of a headset having an earphone incorporating a cushion in accordance with the present invention.

FIG. 1 is a partially expanded isometric view of a headset 10 incorporating an earphone assembly 12, comprising an electro-acoustic transducer, or "speaker" 14 (shown in phantom outline), a comfort-enhancing earphone cushion 16 in accordance with one embodiment of the present invention, and structure 18 for acoustically coupling a through-opening 20 of the cushion 16 to a sound output face 22 of the speaker. In the particular exemplary embodiment illustrated in FIG. 1, the acoustical coupling structure 18 comprises a second resilient ring 24, a third ring (not visible in the figure) captivated within the second ring, and an acoustic plug 28, and is described in more detail below in connection with FIGS. 6–10. However, other structures for acoustically coupling the cushion 16 to the speaker 14 are also possible, as described in more detail below.

The headset 10 may optionally include other elements, such as a means for acoustically coupling an output face of the cushion 16, and hence, the earphone 12 and speaker 14, to a lateral face of an external ear, or auricle, of a listener (not illustrated), which, in the particular embodiment illustrated in FIG. 1, comprises a resilient, arcuate head-band having a first end 32 attached to a housing 34 for the earphone assembly 12, and a second end 36 that includes a pad 38 for pressing against the side of the listener's head opposite to that on which the listening ear and earphone 12 are located. Other means for coupling the earphone 12 to the listener's ear are also known, including resilient, U-shaped yokes that hang below the listener's head of a type familiar to airline travelers, and hook-like hangars that suspend the earphone from the top edge of the external ear, and which include a resilient hinging mechanism that presses the earphone against the ear.

In addition to the head-band 30, the headset 10 may incorporate a microphone 40 to enable two-way voice communication by the wearer. In the embodiment illustrated in FIG. 1, the microphone may be mounted at the end of a boom 42 that is movably attached at a second end to the earphone housing 34 for adjustment relative to the wearer's mouth. Alternatively, the microphone may comprise an omnidirectional microphone 44 that is suspended below the earphone housing 34 by one or more headset input wires 46, as shown by the dashed outlines in FIG. 1.

Figure 2:
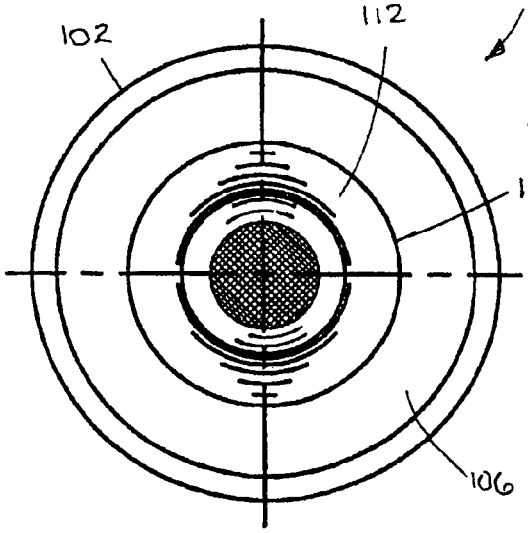
FIG. 2 is a front elevation view of the output face of a first embodiment of an ear-phone cushion in accordance with the present invention.
Figure 3:
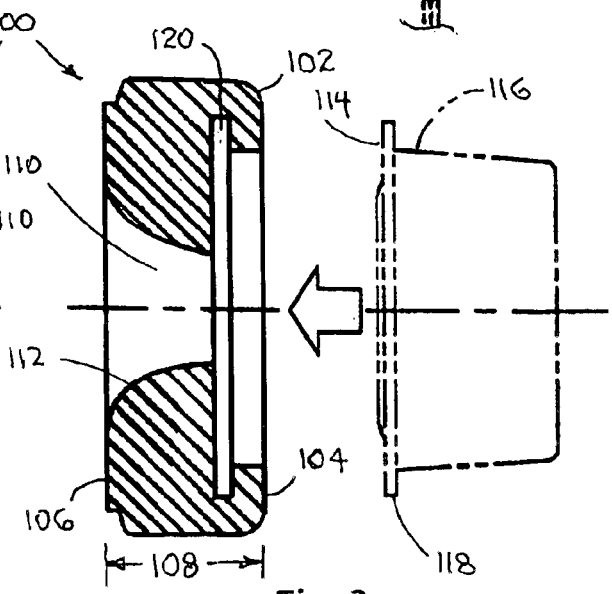
FIG. 3 is a cross-sectional, side elevation view of the earphone cushion of FIG. 2, showing a speaker in phantom lines extracted and spaced apart from an input face of the cushion.

A first embodiment of a comfort-enhancing cushion 100 for an earphone in accordance with the present invention is illustrated in the front elevation and cross-sectional, side elevation views of FIGS. 2 and 3, respectively. As may be seen in the figures, the cushion 100 comprises a first resilient ring 102 having opposite input and output faces 104, 106, a thickness 108 between the two faces, and an opening 110 extending therethrough and defining an interior surface 112 of the ring. Although the first ring 102 of the cushion 100 is shown as substantially annular in shape, the cushions of this invention are not limited to this particular shape, but may incorporate other, differently shaped rings, e.g., they may be oval, elliptical, heart-shaped, or auricular in shape.

The material of the ring 102 may vary widely, so long as it is both resilient and, as discussed below, somewhat elastic. Thus, in one possible embodiment, the ring 102 of the cushion 100 may comprise an elastomer, e.g., a polyurethane, which may be "foamed" with either open or closed cells. Thus, in only one of many possible exemplary manufacturing embodiments, the ring 102 of the cushion 100 is procured in the form of a sheet of elastomer, die-cut from the sheet, and pressed in heated molds (i.e., "thermoformed") into the various ring configurations described herein. Of course, many other manufacturing techniques are also possible.

The input face 104 of the ring 102 has means for acoustically coupling the through-opening 110 of the ring to an output face 114 of a speaker 116, shown in phantom lines in FIG. 2, and the output face 106 of the ring is resiliently conformable to a lateral face of a listener's external ear, or auricle. The speaker 116 may comprise a known type of electromagnetic, piezoelectric, or electrostatic type of driving element, or a combination thereof, or even some other form of driving element, for generating sound waves from the output face of the speaker and in the direction of the arrow shown in FIG. 3.

In the first exemplary embodiment of the cushion 100 illustrated in FIGS. 1 and 2, the acoustical coupling means includes a circumferential flange 118 provided at the output face 114 of the speaker 116. The through-opening 110 at the input face 104 of the ring 102 is configured in size and shape to receive the speaker's output face 114 in a resilient, complementary, slide-in engagement in the direction of the arrow in FIG. 3. Additionally, the interior surface 112 of the ring 102 is provided with a complementary, flange-retaining recess 120 located adjacent to the input face 104 of the ring that is configured to resiliently receive the flange 118 of the speaker in an elastic, "over-center" engagement. That is, the opening 110 at the input face 104 of the ring 102 is stretched out and over the output face 114 end flange 118 of the speaker 116, then allowed to return elastically such that the flange is retained in the recess 120, and the speaker's output face 114 abuts the portion of the interior surface of the ring 102 circumscribing the through-opening 110. A bead of a resilient adhesive (not illustrated) can be dispensed in the recess 120 between the ring 102 and the speaker flange 118 to secure and render the coupling more permanent.

As may be seen in the cross-sectional view of FIG. 3, the interior surface 112 of the ring 102 flares out smoothly between the output face 114 of the speaker, when it is coupled to the ring, and to the output face 106 of the ring, thereby smoothly increasing the cross sectional area of the through-opening 110 between the two output faces. This change in the cross-sectional area of the opening 110 permits the cushion 100 to act as an "acoustical transformer" that matches the acoustical impedances at the two respective cushion and speaker output faces 114 and 106, for more efficient transmission of sound from the speaker to the listener's ear. In one possible embodiment, the interior surface 102 of the opening 10 can flare out uniformly, like a frusto-conical megaphone, and in another embodiment, the interior surface can flare out exponentially, like a horn.

As discussed above, one of the problems associated with wearing headsets for extended periods is the discomfort caused by the build-up of body heat, and hence, temperature, at the interface between the earphone and the ear. It has been discovered that this problem can be significantly reduced by increasing the ability of the earphone, or at least the portion thereof in direct contact with the ear, viz., the cushion, to conduct heat away from the interface, which can be effected by, among other ways, 1) increasing the thermal conductivity of the material of the cushion, and 2) increasing the exterior surface area of the cushion exposed to cooler ambient air.

The first effect above is achieved in an earphone cushion in accordance with the present invention by "filling" or loading the resilient material of the cushion ring, e.g., an elastomer, with microcapsules of a "phase change" substance, i.e., a substance capable of an endothermic, i.e., heat-absorbing, and an exothermic, i.e., heat releasing, change of phase, e.g., from a solid to a liquid and vice-versa, at a substantially constant temperature. Several such substances, and the microcapsules for containing them, are described in U.S. Pat. No. 6,099,894 to M. Holman, assigned to Frisby Technologies, Inc., of Bay Shore, N.Y., and the teachings of which are incorporated herein by this reference.

The temperature at which the encapsulated substance undergoes a phase change can be programmed, or "pre-set," at a particular value, e.g., body temperature, at the time the microcapsules are made, and before they are incorporated into the "host," e.g., the elastomer of the ring. Thus, filling the material of the cushion ring with phase-change microcapsules that are pre-set to change phase at a temperature slightly greater than body temperature has two effects: 1) The effective specific heat of the cushion is increased substantially, thereby rendering the cushion capable of absorbing a substantially greater amount of heat from the interface with the ear than are ordinary materials, and 2) The effective thermal conductivity of the cushion material is substantially increased, thereby enabling the cushion to conduct a greater amount of heat away from the ear interface and to the surrounding ambient air. This latter effect is enhanced even more if the elastomer of the ring is foamed with open cells, which permit circulation of the ambient into the host material and into direct contact with the microcapsules.

The phase-change microcapsule additives are commercially available under the name "Thermasorb" from licensees of Frisby Technologies, Inc., such as 3M, Inc., St. Paul Minn., and open-celled foamed elastomers containing the microcapsules are available under the name "Comfortemp" from other licensees thereof.

Figure 4:
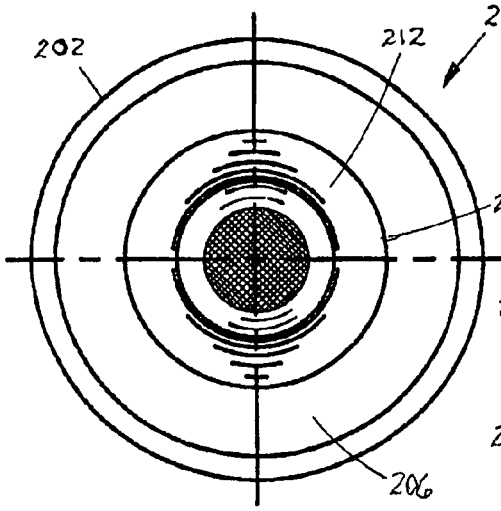
FIG. 4. is a front elevation view of the output face of a second embodiment of an earphone cushion in accordance with the present invention.
Figure 5:
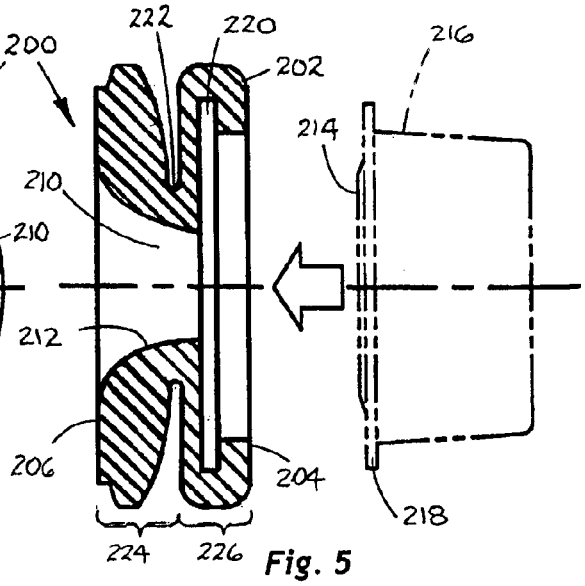
FIG. 5 is a cross-sectional, side elevation view of the earphone cushion of FIG. 4, showing a speaker in phantom lines extracted and spaced apart from an input face of the cushion.

A second embodiment of an ear cushion 200 in accordance with the present invention is illustrated in the front and cross-sectional side elevation views of FIGS. 4 and 5, respectively, wherein elements that are the same or similar to those in the first embodiment of cushion 100 illustrated in FIGS. 2 and 3 are labeled with corresponding reference numerals in which the most significant digit has been incremented by one. By reference to FIGS. 4 and 5, it may be seen that the cushion 200 of the second embodiment is substantially similar to the first embodiment 100, and differs therefrom only by the provision of at least one circumferential recess 222 in the exterior surface of the ring 202 of the cushion between the output face 206 thereof and the flange-retaining recess 220 in the interior surface 212 thereof.

The at least one circumferential recess 222 of the second exemplary embodiment serves at least two desirable comfort functions. First, the recess 222 substantially increases the external surface area of the cushion 200, thereby enabling the cushion to transfer more heat away from the interface with the listener's ear to the ambient air. Second, the recess 222 serves to resiliently articulate an output face portion 224 of the cushion 200 relative to an input face portion 226 thereof, thereby rendering the output face 206 of the cushion more easily compliable to the lateral face of the listener's external ear, without: requiring uncomfortably high contact forces between the cushion and the ear for effective acoustic coupling thereof. The resulting reduction in the required contact force translates directly into enhanced, long-term headset wearer comfort.

Figure 6:
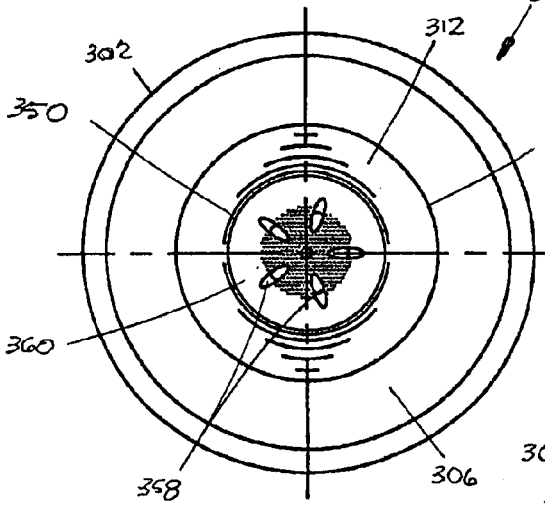
FIG. 6. is a front elevation view of the output face of a third embodiment of an earphone cushion in accordance with the present invention.
Figure 7:
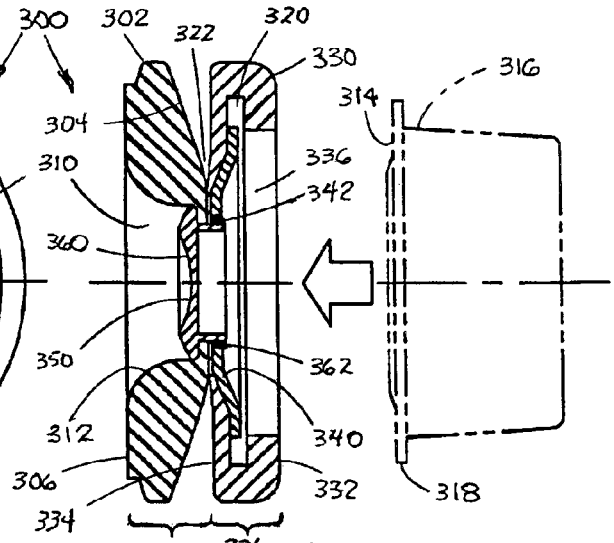
FIG. 7 is a cross-sectional, side elevation view of the earphone cushion of FIG. 6, showing a speaker in phantom lines extracted and spaced apart from an input face of the cushion; and, FIGS. 8–10 are respective cross-sectional, side elevation views of three embodiments of an acoustic plug in accordance with the present invention.

A third exemplary embodiment of an ear cushion 300 in accordance with the present invention is illustrated in the front and cross-sectional side elevation views of FIGS. 6 and 7, respectively, wherein elements that are the same or similar to those in the first and second embodiments of cushion 100 and 200 respectively illustrated in FIGS. 2–5 are labeled with corresponding reference numerals in which the most significant digit has been incremented by two or one, respectively, as above.

As may be seen from the figures, the third embodiment of the cushion 300 comprises a multi-piece structure wherein the structure associated with the input face 304 of the first resilient ring 310 for acoustically coupling the through-opening 310 of the ring 302 to the output face 314 of the speaker 316 includes the provision of a coupling flange 318 on the output face of the speaker, as described above in the first two exemplary embodiments 100 and 200.

Further, a second resilient ring 330 is also provided that has many of the features of the first rings 102 and 202 described above, including opposite input and output faces 332 and 334 and an opening 336 therethrough corresponding to the through-opening 310 in the first ring 302. The opening 336 defines an interior surface in the second ring 330 between the input and output faces 332 and 334, and is configured at the input face to resiliently receive the output face 314 of the speaker 316 in a complementary, slide-in engagement. The interior surface of the second ring 302 is also provided with a flange-retaining recess 320, which is located adjacent to the input face 334 and configured to resiliently receive the flange 318 of the speaker 316, together with a third, rigid retainer ring 340 described below, in a complementary, over-center, elastic engagement.

The third, rigid retainer ring 340 has an opening 342 through it corresponding to the respective openings 310 and 336 of the first and second rings 302 and 330, and an outer periphery configured to be resiliently received in the flange-retaining recess 320 of the second ring in a complementary, over-center engagement, together with the flange 318 of the speaker 316. The third ring 340 cooperates with an acoustic plug 350, described below, to acoustically couple the input face 304 of the first ring 302 to the output face 334 of the second ring 330, and thus, to the output face 314 of the speaker 316, in the manner described below.

Figure 8:
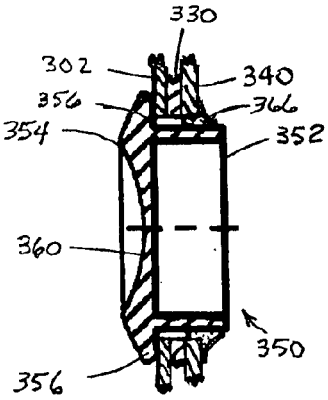
Figure 9:
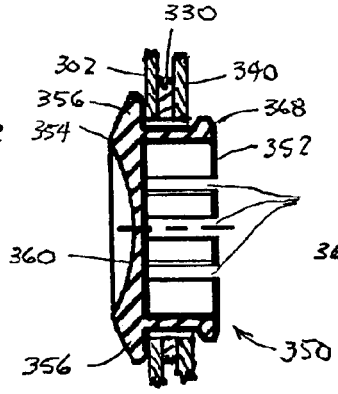
Figure 10:
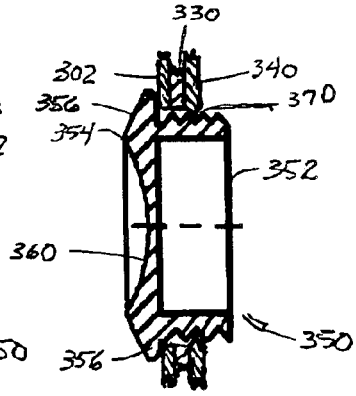

The acoustic plug 350 of the third embodiment of cushion 300, which is shown in the enlarged, cross-section elevation views of FIGS. 8–10, includes an input end 352 corresponding to, and configured to be received through, the respective through-openings 310, 336, and 342 of the first, second and third rings 302, 330, 340, and to be retained therein by the retainer ring 340. The plug 350 further includes an output end 354, a flange 356 circumscribing the output end, and at least one aperture 358 extending through it. The at least one aperture 358 can comprise a single, large bore (not illustrated) that extends completely through both ends of the plug 350, or alternatively, a large counterbore that terminates behind an output face 360 of the plug, as shown in FIGS. 8–10, together with one or more smaller aperture extending through the output face, as shown in FIG. 6, which can be configured in terms of their size, shape, number and distribution on the output face to acoustically "tune" the earphone.

In use, the input end 352 of the plug 350 is inserted through the respective openings 310, 336, and 342 of the first, second and third rings 302, 330, 340, and is retained therein by the third ring such that the flange 356 on the plug presses a first portion of the input face 304 of the first ring 302 tightly against a corresponding portion of the output face 334 of the second ring 330, thereby acoustically coupling the input face of the first ring to the output face 314 of the speaker 316.

As shown in FIG. 7, means 362 use provided for retaining the input end 352 of the plug 350 in the third retainer ring 340. As illustrated in FIG. 8, the retaining means 362 may comprise a bead of an adhesive 364 between the input end 352 of the plug 350 and the third ring 340. Alternatively, a plurality of cams 366 may be supported on the plug's input end 352 and made resiliently deflectable thereat by, e.g., a plurality of elongated slots 368 formed in the input end of tile plug, such that the input end and the cams can snap into the opening 342 of the third ring 340 with an over-center locking engagement, as shown in FIG. 9. In yet another alternative, the retaining means 362 can comprise complementary screw threads 370 on respective ones of the input end of the plug and in the opening 342 of the third ng, in which instance, the plug 350 screws into the opening 342, as illustrated in FIG. 10.

An additional feature of the third embodiment of cushion 300 is illustrated in FIG. 7, viz., that the first ring 302 can be configured such that a second portion of the input face 304 of the first ring circumscribing the flange 356 of the acoustic plug 350 is spaced apart from a corresponding portion of the output face 334 of the second ring 330. The circumferential recess 322 thereby defined affords the cushion 300 with substantially the same comfort benefits that the at least one circumferential recess 222 affords to the second embodiment of cushion 200 described above, viz., improved heat transfer and enhanced compliance with the external ear.

By now, those of skill in the art will appreciate that many modifications, substitutions and alterations can be made to the present invention in terms of its materials, elements and methods without departing from its scope. For example, the output face of the acoustic plug can be faceted and plated with, e.g., a precious metal, to serve as decorative trim. The second ring of the third embodiment can be made of a resilient material having a different texture and/or color for ornamental purposes, or covered with a simulated leather called "leatherette," to lend a rich look and feel to the cushion. A plurality of circumferential recesses can be provided the exterior cushion of the second embodiment to improve its comfort benefits even further.

In light of the foregoing examples, the scope of the present invention should not be limited to that of the particular embodiments thereof described and illustrated herein, as these are merely exemplary in nature, but rather, should be commensurate with that of the claims appended hereafter, and the functional equivalents thereof.

What is claimed is:

1. An earphone cushion, comprising a first resilient ring having opposite input and output faces, a thickness between the faces, and an opening therethrough defining an interior surface between the faces, the input face having associated structure for acoustically coupling the opening to an output face of a speaker, the output face of the first resilient ring being resiliently conformable to a lateral face of an auricle, and the interior surface flaring unidirectionally outwardly for at least a portion of the thickness, the first ring comprising an elastomer comprising microcapsules of a material capable of an endothermic phase change at a substantially constant temperature.

2. The earphone cushion of claim 1, wherein the first ring is annular, oval, elliptical, or auricular in shape.

3. The earphone cushion of claim 1, wherein the interior surface flares out in a direction from the input face to the output face.

4. The earphone cushion of claim 1, wherein the interior surface flares out exponentially.

5. The earphone cushion of claim 1, wherein the microcapsules comprise Frisby Thermasorb microcapsules.

6. The earphone cushion of claim 1, wherein the elastomer is foamed with at least one of open and closed cells.

7. The earphone cushion of claim 1, wherein the first ring comprises Frisby Comfortemp.

8. The earphone cushion of claim 1, wherein the structure associated with the input face of the first ring for acoustically coupling the opening in the first ring to an output face of a speaker comprises the output face of the speaker having an associated flange, the opening at the input face of the first ring being configured to resiliently receive the output face of the speaker in a complementary, slide-in, elastic engagement, and the interior surface of the first ring having a flange-retaining recess located adjacent to the input face of the ring and configured to resiliently receive the flange of the speaker in a complementary, over-center, elastic engagement.

9. The earphone cushion of claim 1, wherein the structure associated with the input face of the first ring for acoustically coupling the opening of the first ring to an output face of a speaker comprises:

the output face of the speaker having an associated flange;

a second resilient ring having opposite input and output faces and an opening therethrough defining an interior surface between the faces, the opening at the input face of the second ring being configured to resiliently receive the output face of the speaker in a complementary, slide-in, elastic engagement, and the interior surface of the second ring having a flange-retaining recess located adjacent to the input face and configured to resiliently receive the flange of the speaker in a complementary, over-center, elastic engagement;

a third retainer ring having an opening therethrough and an outer periphery configured to be resiliently received in the recess of the second ring in a complementary, over-center, elastic engagement adjacent to the flange of the speaker;

an acoustic plug having at least one aperture therethrough, an output end, a flange circumscribing the output end, and an input end corresponding to and configured to be received through the respective openings in the first, second and third rings; and, structure for retaining the input end of the plug in the opening of the third ring such that the flange of the plug presses a first portion of the input face of the first ring against a corresponding portion of the output, face of the second ring and acoustically couples the opening of the first ring to the output face of the speaker.

10. The earphone cushion of claim 8, wherein the first ring has at least one circumferential recess between the output face thereof and the flange-retaining recess in the interior surface thereof.

11. The earphone cushion of claim 9, wherein a second portion of the input face of the first ring circumscribing the flange of the plug is spaced apart from a corresponding portion of the output face of the second ring, thereby defining a circumferential recess between the input face of the first ring and the output face of the second ring.

12. The earphone cushion of claim 9, wherein the structure for retaining the input end of tile plug in the opening of the third retainer ring comprises an adhesive, a plurality of resiliently supported cams on the input end of the plug and complementary threads on respective ones of the input end of the plug and the opening of the third ring.

13. An earphone, comprising:

a cushion in accordance with claim 1; and, a speaker having an output acoustically coupled to the opening of the cushion at the input face thereof.

14. A heat, comprising:

at least one earphone in accordance with claim 13; and, means for acoustically coupling the output face of the cushion to a lateral face of an auricle of a listener.

15. The headset of claim 14, wherein the means for acoustically coupling the output face of the cushion to a lateral face of an auricle of a listener comprises a resilient, arcuate band having a first end attached to the at least one earphone.

16. The headset of claim 14, further comprising a microphone attached to the at least one earphone.

17. The headset of claim 16, wherein the microphone is on a boom attached to the at least one earphone.

18. The headset of claim 16, wherein the microphone is on a wire suspended from the at least one earphone.

19. An earphone cushion, comprising a first ring having opposing first and second faces defining a thickness therebetween, the first ring defining an opening therethrough, the opening defining an interior surface between the faces, the first face having associated structure for acoustically coupling the opening to an output face of a speaker and the second face being resiliently conformable to a lateral face of an auricle, the first ring comprising microcapsules of a material capable of an endothermic phase change at a substantially constant temperature.

20. The earphone cushion of claim 19, wherein the interior surface flares out unidirectionally from the first face to the second face for at least a portion of the thickness.

21. The earphone cushion of claim 19, wherein the microcapsules comprise Frisby Thermasorb microcapsules.

22. The earphone cushion of claim 19, wherein the first ring comprises Frisby Comfortemp.

23. The earphone cushion of claim 19, wherein the structure associated with the first face for acoustically coupling the opening to the output face of the speaker includes a flange-retaining recess located adjacent to the first face and configured to resiliently receive a flange of the output face of the speaker in a complementary elastic engagement.

24. An earphone, comprising:

the earphone cushion of claim 19; and the speaker having the output face acoustically coupled to the opening of the earphone cushion at the first face thereof.

25. An earphone cushion, comprising a first resilient ring having opposite input and output faces, a thickness between the faces, and an opening therethrough defining an interior surface between the faces, the input face having associated structure for acoustically coupling the opening to an output face of a speaker, the output face of the first resilient ring being resiliently conformable to a later face of an auricle, and the interior surface flaring unidirectionally outwardly for at least a portion of the thickness, the interior surface being configured to facilitate in matching acoustical impedances at the output face of the ring and the output face of the speaker when coupled to the ring.

26. An earphone cushion, comprising a first ring having opposing first and second faces defining a thickness therebetween, the first ring defining an opening therethrough, the opening defining an interior surface between the faces, the first face having associated structure for acoustically coupling the opening to an output face of a speaker and the second face being resiliently conformable to a lateral face of an auricle, the interior surface of the ring being configured to facilitate in matching acoustical impedances at the second face of the ring and the output face of the speaker when coupled to the ring, the first ring comprising microcapsules of a material capable of an endothermic phase change at a substantially constant temperature.

* * * * *